US007127990B2

(12) United States Patent
Langsch et al.

(10) Patent No.: US 7,127,990 B2
(45) Date of Patent: Oct. 31, 2006

(54) ROLL FOR A PRINTING PRESS AND PROCESS FOR MANUFACTURING A ROLL

(75) Inventors: Robert Langsch, Ortschwaben (CH); Carlo Manta, Bern (CH)

(73) Assignee: Wifag Maschinenfabrik (CH)

( * ) Notice: Subject to any disclaimer, the term of this patent is extended or adjusted under 35 U.S.C. 154(b) by 0 days.

(21) Appl. No.: 10/820,489

(22) Filed: Apr. 8, 2004

(65) Prior Publication Data

US 2004/0226461 A1 Nov. 18, 2004

(30) Foreign Application Priority Data

Apr. 9, 2003 (DE) ..... 103 16 240

(51) Int. Cl.
*B41F 5/00* (2006.01)

(52) U.S. Cl. ..... 101/147; 101/148; 101/365

(58) Field of Classification Search ..... 101/147, 101/148, 350.1, 351.6, 352.11, 365
See application file for complete search history.

(56) References Cited

U.S. PATENT DOCUMENTS 4,287,827 A * 9/1981 Warner ..... 101/141
4,722,274 A * 2/1988 Jeschke et al. ..... 101/148
5,090,314 A 2/1992 Miescher et al.
5,107,762 A * 4/1992 Fadner et al. ..... 101/148
5,188,030 A * 2/1993 Puschnerat et al. ..... 101/348
5,957,052 A 9/1999 Endisch et al.
6,116,158 A * 9/2000 DeMoore et al. ..... 101/177
2001/0029855 A1* 10/2001 Horikoshi ..... 101/216
2005/0236128 A1* 10/2005 Knuuttila et al. ..... 162/199

FOREIGN PATENT DOCUMENTS

DE 40 12 283 10/1991
DE 196 53 911 7/1998
DE 19926833 A1 * 12/2000
EP 0 203 342 12/1986

* cited by examiner

*Primary Examiner*—Daniel J. Colilla
*Assistant Examiner*—Kevin D. Williams
(74) *Attorney, Agent, or Firm*—McGlew & Tuttle, PC

(57) ABSTRACT

A roll for a printing press has at least two circular partial areas (25, 33) made of an ink-friendly material and at least one circular partial area (23, 34) made of an ink-repellent material, which is arranged between the at least two circular partial areas (25, 33) made of ink-friendly material. A process is provided for manufacturing such a roll, wherein at least two annular structures (25, 33) made of an ink-friendly material and, located between these annular structures, at least one annular structure (23, 34) made of an ink-repellent material are formed on a blank roll body (20, 30).

19 Claims, 4 Drawing Sheets

ROLL FOR A PRINTING PRESS AND PROCESS FOR MANUFACTURING A ROLL

CROSS REFERENCE TO RELATED APPLICATIONS

This application claims the benefit of priority under 35 U.S.C. § 119 of German patent application DE 103 16 240.2 filed Apr. 9, 2003 the entire contents of which are incorporated herein by reference.

FIELD OF THE INVENTION

The present invention pertains to a roll, especially a roll that can be used in a printing press, for example, in the inking or damping system, and to a process for manufacturing such a roll.

BACKGROUND OF THE INVENTION

FIG. 4 shows a roll diagram of a printing couple, through which a web B to be printed on runs. In the arrangement shown in FIG. 4, the web B is first guided over an inking roll 1', with which a first rubber blanket cylinder 2' and a second rubber blanket cylinder 2" are in contact, and is led farther for postdamping over another inking roll 1, with which a first rubber blanket cylinder 2 and a second rubber blanket cylinder 2" are likewise in contact. The roll diagram is described based on the example of a printing couple design used for postdamping. A damping agent applicator roll 11 is in contact with the plate cylinder 3, which is in contact with the rubber blanket cylinder. The damping agent applicator roll 11 is in contact with a distributing roller 12, the so-called damping agent distributor. The damping agent transfer roll 13 is in contact with this distributing roller, and the damping agent transfer roll receives the damping agent sprayed on it via a contactless damping system. The damping agent transfer roll 13, the distributing roller 12 and the damping agent applicator roll 11 transfer the damping agent to the plate cylinder 3, as a result of which the desired predamping and postdamping are achieved.

The inking rolls 4 that are in contact with the plate cylinder 3 transfer ink from the first distributing roller 5*a* that is in contact with them, the first, so-called distributor. The rubber blanket cylinder 6*a*, which is further in contact with a second ink distributor 5*b*, is in contact with the ink distributor 5*a*, and two other rubber blanket cylinders 6*b* and 6*c* are in contact with the said second ink distributor 5*b*. The rubber blanket cylinder 6*c* is in contact with the ink film roll 7, with which the ink doctor roll 8 and the dipping roll 10 are in contact in the known manner. The ink distributor 5*a* is inked in the known manner via the rubber blanket cylinders 6*a*, 6*c*, the additional ink distributor 5*b*, the ink film roll 7, via the ink doctor roll 8, on which the ink is metered by means of doctor knives, which are arranged in the doctor knife bar 9, and via the dipping roll 10, which dips into the ink in the ink tray.

An exemplary inking and damping system is shown in the Applicant's DE 40 12 283 A1 (and corresponding U.S. Pat. No. 5,090,314). DE 40 12 283 A1 and U.S. Pat. No. 5,090,314 are hereby incorporated by reference in their entirety and in particular, the teaching of these documents concerning the design of an inking and damping system is incorporated by reference.

It is known from DE 40 122 83 A1 that distributing rollers have a surface made of copper in order for these rollers to have an ink-friendly surface.

If two different inks are printed on two webs located next to each other, it may happen that the damping agent distributors 12 moving to and fro by an oscillator 14 mix the different inks used in two webs running next to each other, which leads to unsatisfactory printing results.

SUMMARY OF THE INVENTION

One object of the present invention is to provide a roll, especially for a printing press, which reduces or prevents the mixing of inks in the case of webs running next to each other.

According to the invention, a roll for a printing press is provided with at least two partial areas running around the central axis of the roll, which are made of an ink-friendly material. At least one circular partial area made of an ink-repellent material is arranged between the at least two circular partial areas made of ink-friendly material.

The roll according to the present invention is preferably used for postdamping, in which there is a risk that ink flows back into the damping system.

The roll according to the present invention has at least two partial areas or surfaces, which extend around the central axis of the roll and consist of an ink-friendly material, wherein at least one circular partial area or a circular surface, which consists of an ink-repellent material, is arranged between the two circular partial areas or surfaces made of an ink-friendly material. The terms "circular partial area" or "circular surface" are defined in the sense of the present invention as an area of a surface of a roll that extends fully or partially around the circumference of the roll. A circular surface may have, for example, an annular design or have one or more ring segments, the surface being advantageously designed corresponding to the surface of the roll and being preferably arranged around the central axis of the roll and especially advantageously having approximately the same curvature as the curvature of the adjacent roll surface. Thus, according to one embodiment, a first circular surface or an annular element made of an ink-friendly material, an annular element adjoining same and made of an ink-repellent material, and, adjoining the latter, a second annular element made of an ink-friendly material are arranged according to the present invention in the axial direction of a roll, as a result of which the two annular elements made of ink-friendly material are separated by the annular element made of an ink-repellent material.

A material that is "ink-friendly" in the sense of the present invention shall have, for example, such physical and/or chemical properties that a roll coated with such a material can assume the function of an inking roll, i.e., it can absorb ink. An ink-friendly material preferably possesses hydrophobic properties. Correspondingly, a material that is "ink-repellent" in the sense of the present invention shall be a material that possesses such physical and/or chemical properties that the roll can assume the function of a damping roll, i.e., it can absorb water, in an area coated with an ink-repellent material. The ink-repellent material shall preferably possess hydrophilic properties or be hydrophilic.

A ceramic, copper, polyamide or Rilsan (R) is preferably used as the ink-friendly or hydrophobic material.

Various ink-friendly and ink-repellent materials are known in the state of the art. Reference is made as an example to the teachings of EP 0 203 342 A2 and DE 196 53 911 A1 (corresponding to U.S. Pat. No. 5,957,052). The disclosure of each of EP 0 203 342 A2; DE 196 53 911 A1; and U.S. Pat. No. 5,957,052 are hereby incorporated by reference in their entirety, particularly concerning the materials for coating roll surfaces is incorporated in this application.

A plurality of areas or circular surfaces made of ink-friendly material are advantageously arranged one after another in the axial direction in a roll according to the present invention, and at least one area or a circular surface each, made of an ink-repellent or hydrophilic material, is arranged between those said areas or surfaces. For example, four ink-friendly partial areas, which are separated from one another by three partial areas made of hydrophilic or ink-repellent material, may be provided one after another in the axial direction in a roll according to one exemplary embodiment.

The thickness of the ink-friendly material is preferably in a range of 0.1 mm to 0.5 mm and especially preferably 0.3 mm. The thickness of the ink-repellent or hydrophilic material is advantageously in the range of 0.01 mm to 0.10 mm, more preferably in the range of 0.02 mm to 0.05 mm and advantageously 0.035 mm.

The width of a circular surface or a partial area made of ink-friendly material is preferably approximately the width of a printing area and is advantageously in the range of 25 cm to 35 cm. The width of the partial area made of hydrophilic material is preferably somewhat greater than the stroke of a distribution roll and is advantageously in the range of 18 mm to 26 mm and advantageously equals 22 mm.

According to another aspect, the present invention pertains to an inking and/or damping system for offset printing presses with at least one roll as described above.

According to another aspect, the present invention pertains to a process for manufacturing a roll as described above, wherein at least two annular or ring segment-shaped structures made of an ink-friendly material and, between them, at least one annular structure made of an ink-repellent material in the surface area or directly on the surface of the roll are formed, i.e., for example, exposed, arranged or coated on a blank roll body.

The roll according to the present invention is advantageously manufactured by premachining a blank roll body or tube by turning in order to obtain a surface with a designed surface quality. According to one embodiment, one or more partial areas made of an ink-friendly and ink-repellent material may already be provided in the blank roll body. It is also possible to apply an ink-friendly or ink-repellent material to the blank roll body in the desired areas. The application of an ink-friendly or ink-repellent material may be carried out, for example, by chrome-plating, facing or by a coating method, for example, plasma coating. An area at the transition between ink-friendly and ink-repellent materials or an edge area may be advantageously sealed in order to prevent, e.g., moisture from penetrating into the roll. After the application and/or exposure and/or finishing of the materials made of ink-friendly and/or ink-repellent material, finishing of the roll thus manufactured may be performed by turning or polishing in order to obtain a roll that can be used, for example, in an inking or damping system of a printing press.

The present invention will be described below on the basis of preferred exemplary embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
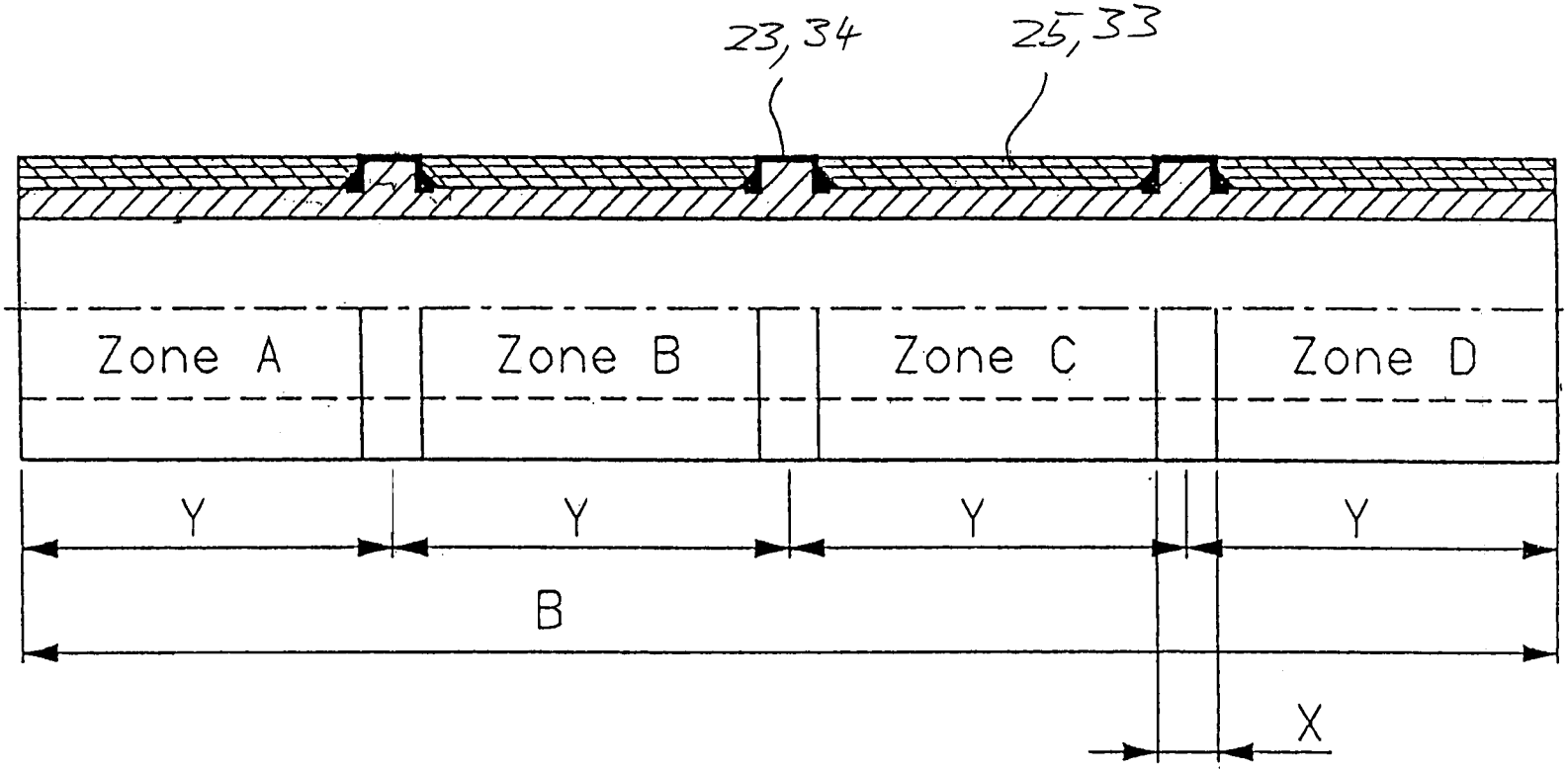
FIG. 1 is a schematic sectional view of a partial area of a roll according to the present invention.

FIG. 1 shows in a sectional view a partial area of a roll according to the present invention, the design of the roll being shown from the central axis toward the surface. The roll shown as an example is divided into four sections having the width Y, assigned to the zones A through D, which have approximately equal width each and approximately correspond to a printing area. An ink-friendly or hydrophobic material 25, 33, for example, ceramic, copper, polyamide or Rilsan (R), is applied with a layer thickness of approx. 0.3 mm to the surface in the zones A through D. Ink-repellent or hydrophilic material 23, 24, chromium in the exemplary embodiment, is applied with a layer thickness of approx. 0.02 mm to 0.05 mm and a width of approx. 20 mm to 24 mm on the surface between the areas with ink-friendly material. The surface of the roll according to the present invention is consequently designed to be such that an ink-friendly material, which is associated with the printing area, and a hydrophilic material, which is located between two adjacent ink-friendly materials, are arranged alternatingly over the surface, which corresponds more or less to a paper width B for the printing.

A damping agent distribution roll provided with such a surface, which is moved to and fro in the axial direction with a stroke of, e.g., 20 mm during use in printing, ensures, on the one hand, that the transfer of an ink is possible due to the ink-friendly material associated with the printing area, and, on the other hand, it prevents inks that run next to one another in adjacent zones from being able to be mixed together due to the ink-repellent or hydrophilic material located between the areas made of ink-friendly material. The surface area made of hydrophilic material ensures the sufficient supply and drainage of water during the operation and can thus remove an ink flowing beyond the edge of a zone or a printing area and thus prevent this ink from running into an adjacent zone or an adjacent printing area.

Figure 2:
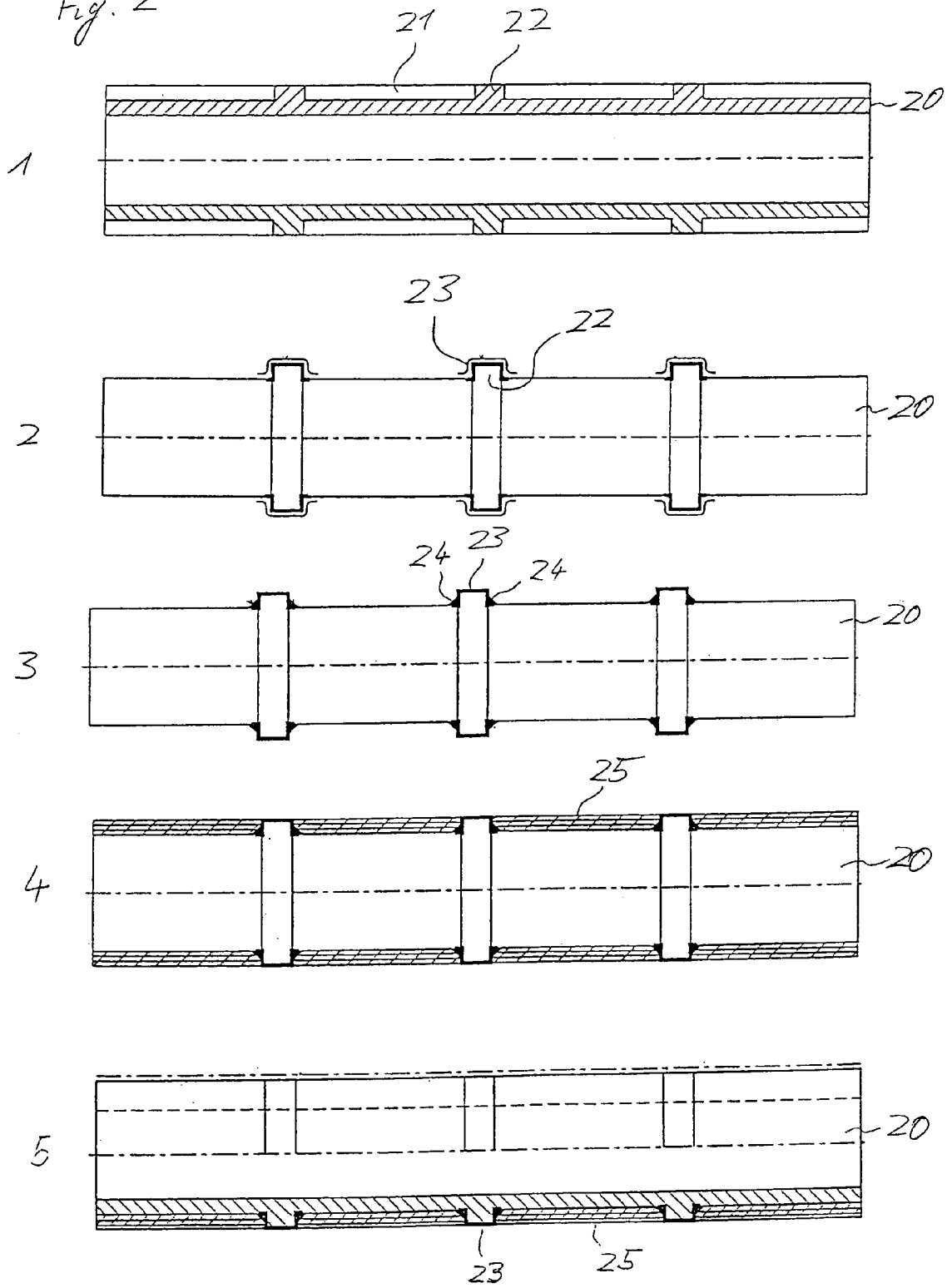
FIG. 2 is a first exemplary embodiment of a process according to the present invention for manufacturing a roll.

FIG. 2 shows a first embodiment of a process according to the present invention for manufacturing a roll according to the present invention. In the initial state designated by 1, there is a blank roll body or tube 20, which is premachined by turning such that four circular depressions 21 are produced. A circular projection 22 each is located between two depressions 21 each.

Each circular projection 22 is chrome-plated in step 2 and a layer of chromium 23 is thus applied.

Next, a weld seam 24 is applied at the transitions designated by 24 between the chromium 23 applied and the blank roll body 20 in order to produce a waterproof sealing at the edge of the chromium layer 23. The weld seam 24 may be preferably applied in order to guarantee better adhesion of the ink-friendly or hydrophobic coating 25 to be applied in step 4.

For example, a polyamide may be applied as an ink-friendly layer 25. It is possible to carry out plasma coating in order to prepare the ink-friendly coating 25. Hard chrome plating may be performed as well. Rilsan is advantageously applied as an ink-friendly material 25 to the roll 20. The ink-friendly layer may be applied either as a single layer or in a plurality of layers—three layers in the exemplary embodiment—to the roll 20.

As is shown in step 5, the roll 20 manufactured in the processing steps 1 through 4 may be finally polished or turned in order to obtain an essentially flat surface with circular ink-friendly partial areas 25, which are interrupted or separated from each other by circular ink-repellent or hydrophilic partial areas 23.

Figure 3:
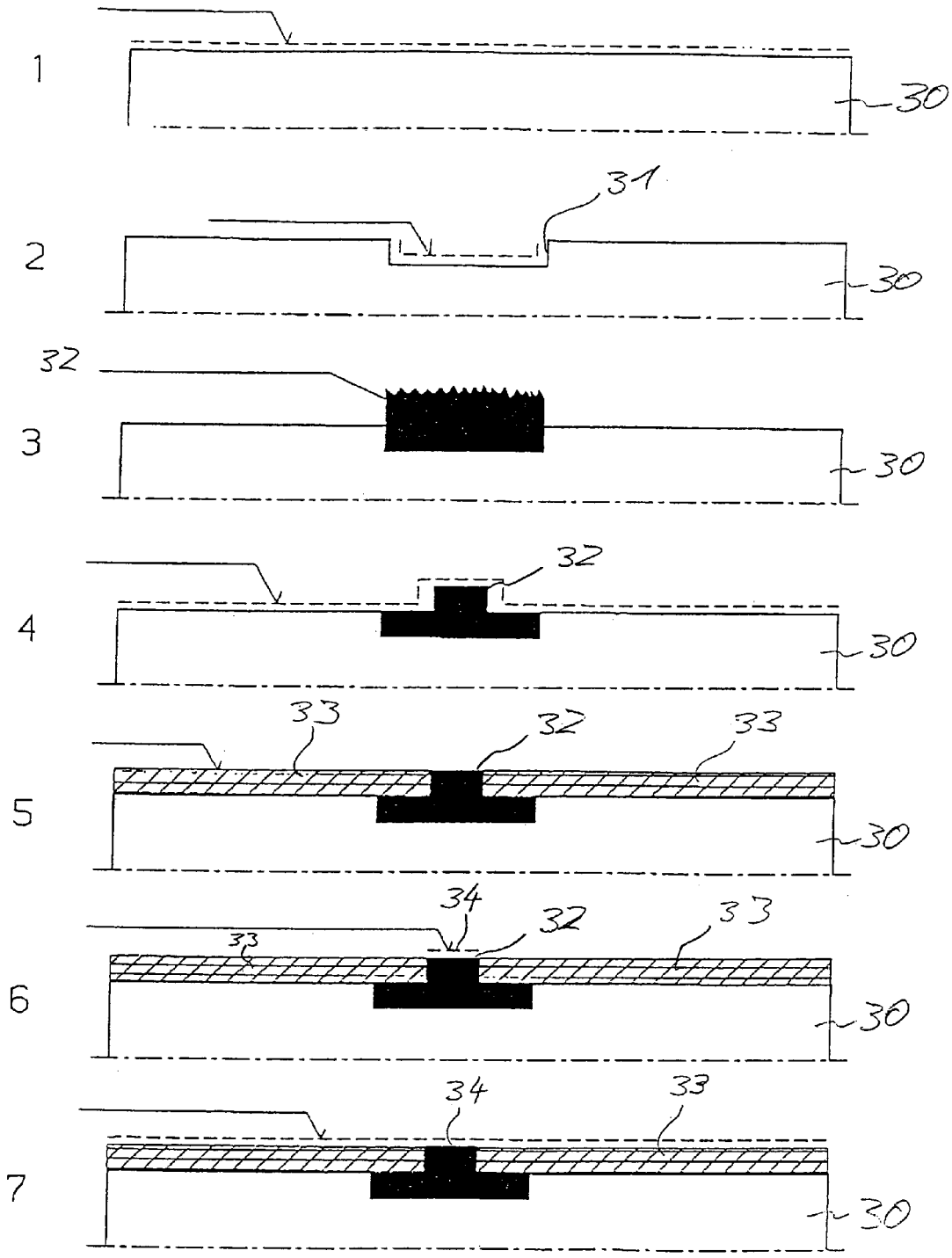
FIG. 3 is a second exemplary embodiment of a process according to the present invention for manufacturing a roll.
Figure 4:
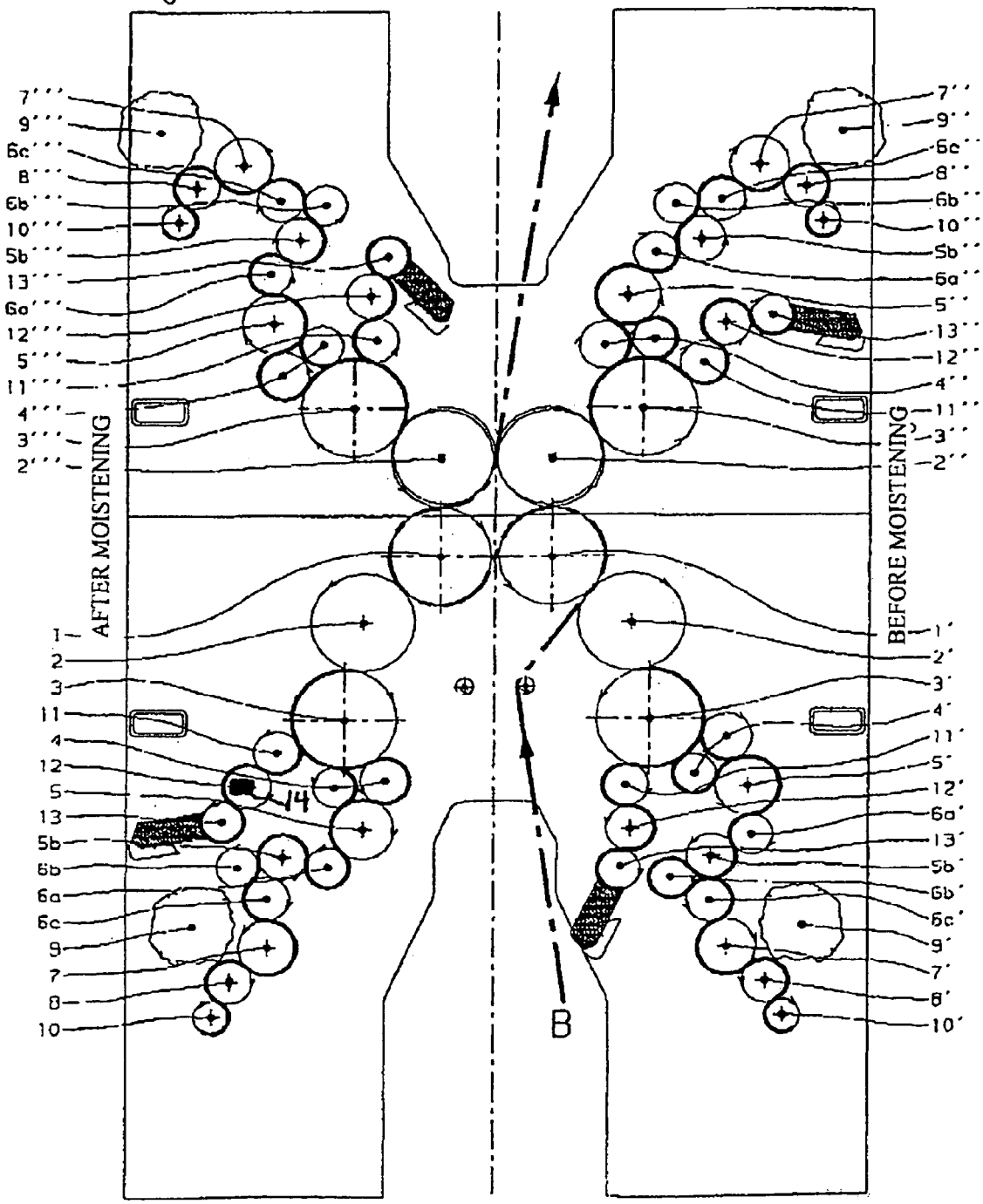
FIG. 4 is a roll diagram for the explanation of the use of a roll according to the present invention.

FIG. 3 shows process steps for carrying out a second process according to the present invention for manufacturing the roll according to the present invention.

In step 1, a blank roll body 30 is machined by turning on the surface indicated by the arrow in order to make the surface of the blank roll body 30 more planar for the subsequent manufacturing processes. A depression 31 running around the central axis of the blank roll body 30 is subsequently prepared in step 2 by cropping or another material-removing process. As is shown in step 3, a material 32 is subsequently introduced into the depression 31 prepared in step 2 by facing with a stainless material. As is shown in step 4, the surface of the blank roll body prepared in steps 1 through 3 is brought to a desired shape by preturning, and the outer surface of the material 32 applied in-step 3 is made planar, and the width of this material 32 is reduced to the desired width.

An ink-friendly material 33, for example, Rilsan (R), is applied in the next step 5 to the surface areas of the blank roll body 30, which adjoin the projecting area of the material 32. As is described in connection with FIG. 2, one or more layers of the ink-friendly material 33 may be applied. The outer surface of the material 32 embedded between the ink-friendly material 33 is hard chrome-plated in step 6 in order to apply an ink-repellent chromium layer, and the blank roll body 30 processed in steps 1 through 6 is polished in step 7 in order to obtain an essentially planar outer surface.

Even though exemplary embodiments for manufacturing rolls or roll surfaces with four and two partial areas made of an ink-friendly material are shown in FIGS. 2 and 3, these processes can be used to prepare any desired number of coatings with ink-friendly and ink-repellent surfaces on rollers.

While specific embodiments of the invention have been shown and described in detail to illustrate the application of the principles of the invention, it will be understood that the invention may be embodied otherwise without departing from such principles.

What is claimed is:

1. A damping system for a printing press printing a plurality of printing areas transversely across a web, the system comprising:

a roll with at least two partial areas running around the central axis of the roll, said partial areas being made of an ink-friendly material and at least one annular area made of an ink-repellent material, said annular area made of an ink-repellent material being arranged between said at least two partial areas made of ink-friendly material;

an oscillator connected to said roll and moving said roll to and fro in an axial direction; a plate cylinder receiving damping agent from said roll, said plate cylinder having a plurality of printing areas to print on the printing areas of the web, each said plate printing area being annular and extending uninterrupted in a circumferential direction of said plate cylinder, each said plate printing area printing a different ink, said ink repellent material having a size to prevent mixing of ink between printing areas of said plate cylinder.

2. A damping system in accordance with claim 1, wherein:

said annular area extends uninterrupted in a circumferential direction of said roll.

3. A damping system in accordance with claim 1, further comprising:

a damping agent transfer roll in contact with said roll and transferring damping agent to said roll;

a damping agent applicator roll in contact with said roll and receiving damping agent from said roll.

4. A damping system in accordance with claim 1, wherein:

said first and second partial areas having a width substantially equal to a width of a respective printing area of said plate cylinder.

5. A damping system in accordance with claim 1, wherein:

said oscillator moves said roll to and fro by a predetermined stroke;

a width of said ink-repellent area is larger than said stroke.

6. A damping system in accordance with claim 1, further comprising:

an inking system applying ink to said plate cylinder at a location upstream of said roll.

7. A damping system comprising:

a distributing roll with a plurality of partial areas running around a central axis of said distributing roll, said partial areas being made of an ink-friendly material, an annular area made of an ink-repellent material being arranged between said partial areas made of ink-friendly material, said ink-repellent area extending fully around said central axis of said distributing roll;

an oscillator connected to said distributing roll and moving said distributing roll to and fro in an axial direction;

a damping agent transfer roll in contact with said distributing roll and transferring damping agent to said distributing roll;

a damping agent applicator roll in contact with said distributing roll and receiving damping agent from said distributing roll.

8. A damping system in accordance with claim 7, further comprising:

a plate cylinder receiving damping agent from said damping agent applicator roll.

9. A damping system in accordance with claim 7, wherein:

said partial areas extend uninterrupted in a circumferential direction of said distributing roll.

10. A system in accordance with claim 7, wherein:

said plate cylinder has a plurality of printing areas to print on printing areas of the web, said ink repellent material having a size to prevent mixing of ihk between printing areas of said plate cylinder.

11. A system in accordance with claim 7, wherein:

said plate cylinder has a plurality of printing areas to print on printing areas of the web, each said partial corresponding to of said printing areas and having a width substantially equal to a width of a respective printing area.

12. A damping system in accordance with claim 7, wherein:

said oscillator moves said distributing roll to and fro by a predetermined stroke;

a width of said ink-repellent area is larger than said stroke.

13. A damping system in accordance with claim 7, further comprising:

an inking system applying ink to said plate cylinder at a location upstream of said distributing roll.

14. A roll arrangement for a printing press printing a plurality of printing areas transversely across a web, the roll arrangement comprising;

a roll;

a plurality of ink-friendly areas mounted on said roll and extending around a central axis of said roll, each of said ink-friendly areas corresponding to one of the plurality of printing areas, said each ink-friendly area having an axial width substantially equal to a width of a respective printing area;

an ink-repellent area mounted on said roll and extending fully around said central axis of said roll, said ink-repellent area extending uninterrupted in a circumferential direction of said roll, said ink-repellent area being arranged between two of said ink-friendly areas a damping agent transfer roll in contact with said roll and transferring damping agent to said roll;

a damping agent applicator roll in contact with said roll and receiving damping agent from said roll.

15. A roll arrangement in accordance with claim 14, wherein:

said each ink-friendly area has a size and shape substantially equal to a size and shape of a respective printing area, said each ink-friendly area extending uninterrupted in a circumferential direction of said roll.

16. A roll arrangement in accordance with claim 14, further comprising:

an oscillator connected to said roll and moving said roll to and fro in an axial direction.

17. A roll arrangement in accordance with claim 16, wherein:

said oscillator moves said roll to and fro by a predetermined stroke;

a width of said ink-repellent area is larger than said stroke.

18. A roll arrangement in accordance with claim 14, further comprising:

a plate cylinder receiving damping agent from said damping agent applicator roll.

19. A roll arrangement in accordance with claim 14, further comprising:

a plate cylinder receiving damping agent from said roll;

an inking system applying ink to said plate cylinder at a location upstream of said roll.

* * * * *